US008241471B2

(12) United States Patent
Griffin

(10) Patent No.: US 8,241,471 B2
(45) Date of Patent: Aug. 14, 2012

(54) HYDROGEN PRODUCTION SYSTEMS UTILIZING ELECTRODES FORMED FROM NANO-PARTICLES SUSPENDED IN AN ELECTROLYTE

(76) Inventor: Linnard Gene Griffin, Bertram, TX (US)

( * ) Notice: Subject to any disclaimer, the term of this patent is extended or adjusted under 35 U.S.C. 154(b) by 463 days.

(21) Appl. No.: 12/613,917

(22) Filed: Nov. 6, 2009

(65) Prior Publication Data

US 2010/0108498 A1 May 6, 2010

Related U.S. Application Data

(60) Provisional application No. 61/111,991, filed on Nov. 6, 2008.

(51) Int. Cl.

| | |
|---|---|
| ***C25B 11/00*** | (2006.01) |
| ***C25B 11/02*** | (2006.01) |
| ***C25B 11/04*** | (2006.01) |
| ***C25B 9/00*** | (2006.01) |
| ***C25B 1/02*** | (2006.01) |

(52) U.S. Cl. ..... 204/242; 204/280; 204/290.01; 204/293; 204/297.02; 205/638; 205/639

(58) Field of Classification Search ..... 204/157.52, 204/242, 280–294, 297.02; 205/339, 348, 205/637–639

See application file for complete search history.

(56) References Cited

U.S. PATENT DOCUMENTS

| | | | | |
|---|---|---|---|---|
| 4,202,744 | A * | 5/1980 | Pan et al. | 205/339 |
| 2004/0256222 | A1 * | 12/2004 | Griego et al. | 204/280 |
| 2005/0042150 | A1 * | 2/2005 | Griffin | 422/139 |
| 2006/0049038 | A1 * | 3/2006 | Griego et al. | 204/228.1 |
| 2006/0180464 | A1 * | 8/2006 | Griffin | 204/280 |
| 2006/0188436 | A1 * | 8/2006 | Griffin | 423/657 |
| 2009/0152126 | A1 * | 6/2009 | Griffin | 205/632 |

* cited by examiner

*Primary Examiner* — Mark F Huff
*Assistant Examiner* — Ciel Thomas
(74) *Attorney, Agent, or Firm* — Storm PLLC; Paul V. Storm

(57) ABSTRACT

An electrolytic system for generating hydrogen gas includes a pair of electrodes and an electrolyte. The electrolyte includes colloidal silver, colloidal magnesium, and a nano-metal comprising nano-nickel, nano-iron or a nano-nickel-iron alloy. The electrodes include a first electrode of a non-magnetic material. A second electrode includes an electrode precursor of a magnetic material or an electro-magnet. When in its magnetic state, the electrode precursor exerts a magnetic force of sufficient strength to pull the nano-metal of the electrolyte onto at least a portion of its surfaces, to form the second electrode.

19 Claims, 4 Drawing Sheets

HYDROGEN PRODUCTION SYSTEMS UTILIZING ELECTRODES FORMED FROM NANO-PARTICLES SUSPENDED IN AN ELECTROLYTE

STATEMENT OF RELATED APPLICATIONS

This application claims priority from provisional U.S. Application No. 61/111,991, filed Nov. 6, 2008.

BACKGROUND

1. Technical Field

The technology relates to the production of hydrogen, and more particularly to the use of chemical reaction to produce hydrogen in a system that includes an electrode formed from metallic nano-particles suspended in an electrolyte.

2. Description of the Related Art

There is a growing demand for sources of energy other than from the combustion of fossil fuels. The combustion of these fuels has long been associated with the production of undesirable combustion gas products, such as sulfur dioxide. In more recent years, it has also become a matter of concern that the combustion of fossil fuels releases carbon dioxide into the atmosphere. The growing concentration of carbon dioxide has been implicated in the phenomenon variously known as "global warming" or "climate change." Accordingly, there is a desire to develop other sources of energy, or to find ways to utilize fossil fuels which may entail technologies that either sequester or otherwise remove the potential for carbon dioxide release into the atmosphere.

Among the proposed alternatives to fossil fuels as a source of energy that do not release carbon dioxide are solar power, wind power, nuclear power, marine (wave) power and hydrogen. Each of these power sources poses challenges and each may occupy a niche in a long term energy strategy aimed at minimizing the release of carbon dioxide into the atmosphere. Hydrogen is a plentiful elemental gas but is usually chemically bound or in the atmosphere in a relatively small percentage. Accordingly, the large scale use of hydrogen requires technologies that will produce hydrogen from its chemically bound state and permit its capture in a form useful for conversion to energy, by combustion or otherwise. Much attention has been devoted to fuel cell technology, and the use of hydrogen as a potential automotive fuel is also being explored.

SUMMARY

An exemplary embodiment provides a controlled electrolysis system for generating hydrogen gas by creating an electrode with a magnetic field and controlling the magnetic field strength to control a rate of hydrogen production. The system includes a first electrode and an electrolyte in contact with it that includes colloidal silver, colloidal magnesium, and nano-metal particles. The system also has a conductive body portion in contact with the electrolyte. Further, it includes a magnetic element having a magnetic field at least partially encompassing the conductive body portion. The magnetic field pulls nano-metal particles from the electrolyte to at least partially coat a surface of the conductive body portion to form a second electrode. The strength of the magnetic field is controllable to either increase or decrease a rate of hydrogen production by controlling an extent of the surface of the conductive body portion coated with nano-metal particles.

A further exemplary embodiment provides a system for controlled generation of hydrogen gas by creating an electrode with a magnetic field and controlling the magnetic field strength to control a rate of hydrogen production. The system includes a first non-magnetic electrode and, in contact with it, an electrolyte that includes colloidal silver, colloidal magnesium, and nano-metal particles. In addition, it has a hollow body having a conductive portion and an insulated portion. The hollow body is in contact with the electrolyte. Further, it has a magnetic element having a magnetic field. The magnetic field at least partially encompasses the hollow body and pulls nano-metal particles from the electrolyte to at least partially coat an outer surface of the conductive portion to form a second electrolyte and produce hydrogen. The extent of influence of the magnetic field on the conductive portion is controlledly variable to control the rate of hydrogen production.

Another exemplary embodiment provides a system for controlled generation of hydrogen gas by creating an electrode with a magnetic field and controlling the magnetic field strength to control a rate of hydrogen production. The system includes a cell that has a first non-magnetic electrode, an electrolyte in contact with it, and a hollow body that forms a second electrode, when coated with nano-metal particles, under influence of a magnetic field. The electrolyte may include colloidal silver, colloidal magnesium, and nano-metal particles. The nano-metal particles may include at least one of nano-nickel, nano-iron or a nano-nickel-iron alloy. The hollow body has a conductive portion and an insulated portion and is in contact with the electrolyte. The hollow conductive body is coated with nano-metal from the electrolyte to form a second electrode, when the system is in hydrogen production mode. Further, the system includes at least one controlled magnetic element located within the hollow body and pulling nano-metal particles from the electrolyte to at least partially coat an outer surface of the hollow body to form the second electrode to produce hydrogen by electrolysis. The magnetic element controls a rate of hydrogen production by controlling the strength of the magnetic field at the conductive portion of the hollow body. The system also includes a gas-tight end cover enclosing contents of the cell, the end cover having an outlet therein for removal of produced hydrogen.

BRIEF DESCRIPTION OF THE DRAWINGS

For a more complete understanding of the present technology, and the advantages thereof, reference is now made to the following description taken in conjunction with the accompanying schematic, not-to-scale drawings in which.

DETAILED DESCRIPTION

In the following description, numerous details may be set forth to provide a thorough understanding of the present technology. However, it will be apparent to those skilled in the art that the present technology may be practiced without some of these specific details. For the most part, details considering alternate material choices and design configurations and the like have been omitted inasmuch as details are not necessary to obtain complete understanding of the present technology and are within the skills of persons of ordinary skill in the relevant art.

In the specification, the term "exemplary embodiment" means a non limiting example of an embodiment of the technology.

Figure 1:
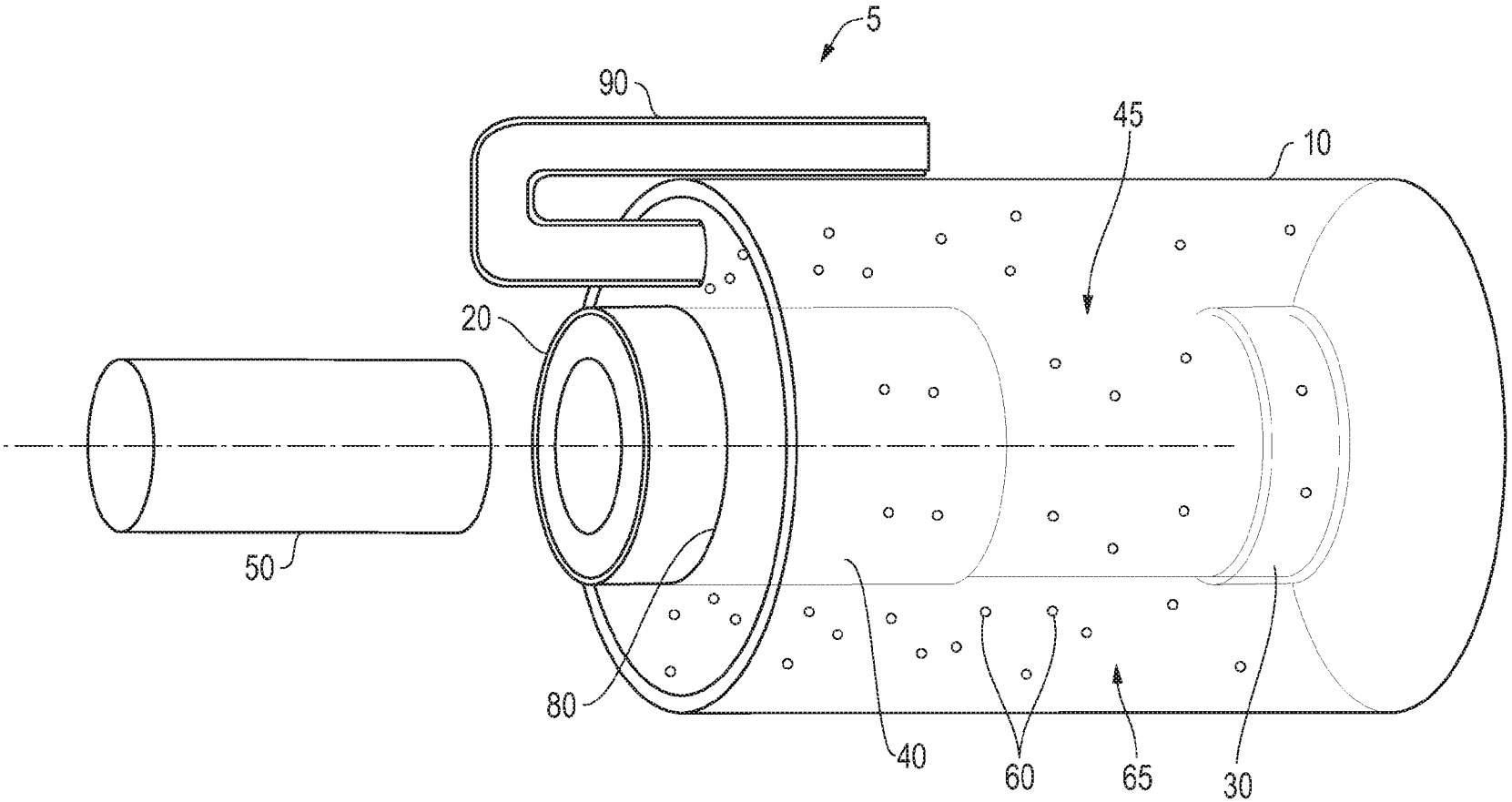
FIG. 1 illustrates an exemplary embodiment of a system including a magnetic electrode.

FIG. 1 illustrates a simplified exemplary embodiment of a system that is a single cell hydrogen generator 5 that includes a chemical inert container 10, in this instance an elongate container, of a non-magnetic material, typically a chemically inert material. Container 10 may vary in configuration. Container 10 includes a hollow electrical (copper or any other conductive material which is non-reactive) conductor 20 and a zinc electrode 30 abuts one end of the conductor 20. Exemplary embodiments may have either zinc electrodes or aluminum electrodes when the electrolyte contains zinc hydroxide so that zinc will plate out onto the aluminum electrode. Other non-magnetic electrode materials may also be used. The conductor 20 may be of any configuration that is suitable. In this example, conductor 20 is composed of a hollow, copper tube. Conductor 20 is divided into two sections (insulated portion 40 and conductive portion 45), the outer surface of conductor 20 exposed to the electrolyte 65. The second electrode is formed by nano-metal particles, such as nano-nickel and iron particles, attracted to and coated over the non-insulated area, conductive portion 45, of conductor 20, in the illustrated example. The hollow interior of conductor 20 is accessible from outside of container 10 through a port in the end seal 80, which also has an outlet 90 for produced hydrogen gas. This allows the movable magnetic element 50 to be selectively positioned within conductor 20 to control hydrogen production. Hydrogen production is at a maximum when the magnetic element 50 is fully inserted into the conductive portion 45 of the conductor and the maximum area of this conductive portion 45 is coated with attracted nano-metal particles. As the magnetic element 50 is withdrawn, the area of the conductor 20 that is coated with nano-metal is reduced (and hydrogen production is also reduced) until the magnet is completely shielded within insulated portion 40. When magnetic element 50 is completely shielded within insulated portion 40, the magnetic field strength at conductive portion 45 is weak or non-existent and the conductive portion 45 is substantially free of magnetically attracted nano-metal particles. At this point, hydrogen production is minimized or terminated. Thus, the movement of magnetic element 50, which affects the magnetic field strength at the conductive portion 45, acts to control hydrogen production.

Figure 2:
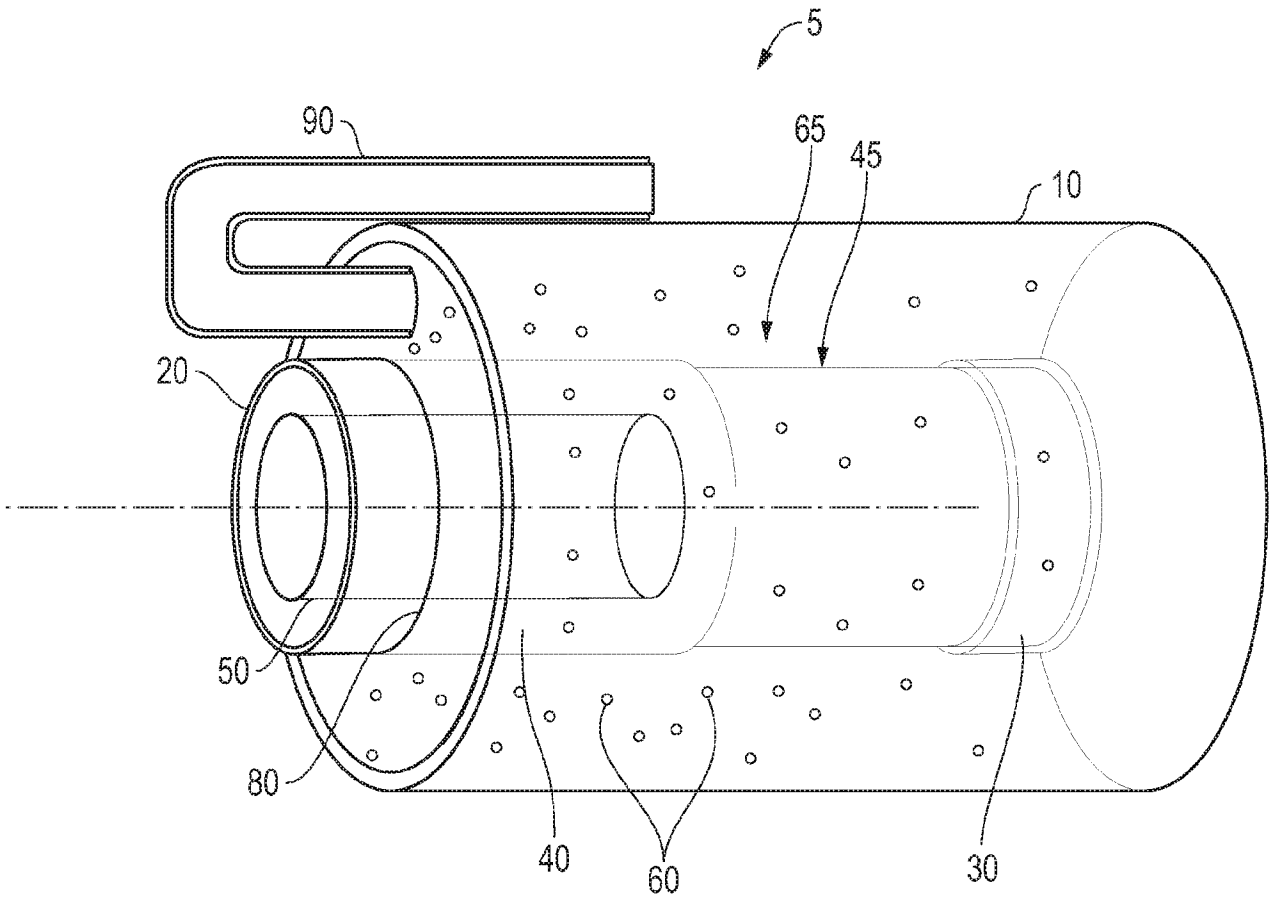
FIG. 2 illustrates another exemplary embodiment of a system including a magnetic electrode in the OFF state.

The second electrode (conductive portion 45 as coated with nano-metal) is produced by the magnetic field effects of a movable magnetic element 50 and nano-particles 60 of the electrolyte 65. Thus, when the magnetic element 50 is in the insulated portion 40 of conductor 20, as illustrated in FIG. 2, the cell 5 is inactive. In this "off" mode, the presence of the magnetic field of magnetic element 50 attracts metallic nano-particles 60 of the electrolyte 65 to the outer surfaces of the insulated portion 40, resulting in no hydrogen production. When the magnetic element 50 is moved into the conductive portion 45 of conductor 20, the attracted nano-particles follow the magnetic field, thereby forming a metallic nano-particle coating on the outside surface of the conductive portion 45, thereby forming the second electrode. In this "on" mode, the hydrogen generator cell 5 is active and produces hydrogen. Thus, the magnetic element 50 should be in a position to exert a sufficiently strong magnetic field strength on the conductive portion 45 of conductor 20 to attract nano-metal particles to it to form the second electrode. Once the second electrode is formed, hydrogen production commences. As the magnetic field moves to cover a greater portion of the area of conductive portion 45, the extent of the proportion of the area of conductive portion 45 coated with nano-metal particles increases, and hydrogen production increases. Likewise, as the magnetic element 50 retreats and the magnetic field encompasses less of the area of conductive portion 45, the area of nano-metal coating is reduced, and consequently hydrogen production is reduced.

An exemplary embodiment of a movable magnetic element 50 may selected, for example, from the rare earth magnets, or any other magnetic material that will attract magnetic nano-particles, such as nickel and nano-iron, so strongly as to cause these particles to move through electrolyte 60 to attach to insulated surfaces of conductor 20 (off position) or to the non-insulated portion of conductor 20 (on position) forming the second electrode. These magnetic nano-particles may be selected from nano-nickel, nano-iron, nano-alloys of nickel and iron, or other nano-metals, such as tungsten, tungsten carbide, platinum, etc.

An exemplary embodiment of the electrolyte 65 may include colloidal silver, colloidal magnesium, sodium hydroxide, potassium hydroxide and distilled water. Into this electrolyte solution is placed nano-nickel and nano-iron particles. For example, a 100 ml solution might be composed of 10 ml of colloidal silver, 10 ml of colloidal magnesium, 80 ml of distilled water, and 33 grams of the hydroxide. To this may be added 0.5 grams of nano-nickel and 0.5 grams of nano-iron particles.

FIG. 2 shows an exemplary embodiment of a hydrogen generator cell 5 with the magnetic element 50 in the "off" position, when no hydrogen is produced. The magnetic element 50 is within the insulated layer 40 and this attracts the nano-metal particles to the surface of the insulated layer 40. In an exemplary embodiment, the magnetic field pulls substantially all the nano-nickel and nano-iron particles onto the outer surface of hollow conductor 20. No second electrode is formed, because the nano-metal particles coat an insulated portion 40, and thus there is no hydrogen production.

Figure 3:
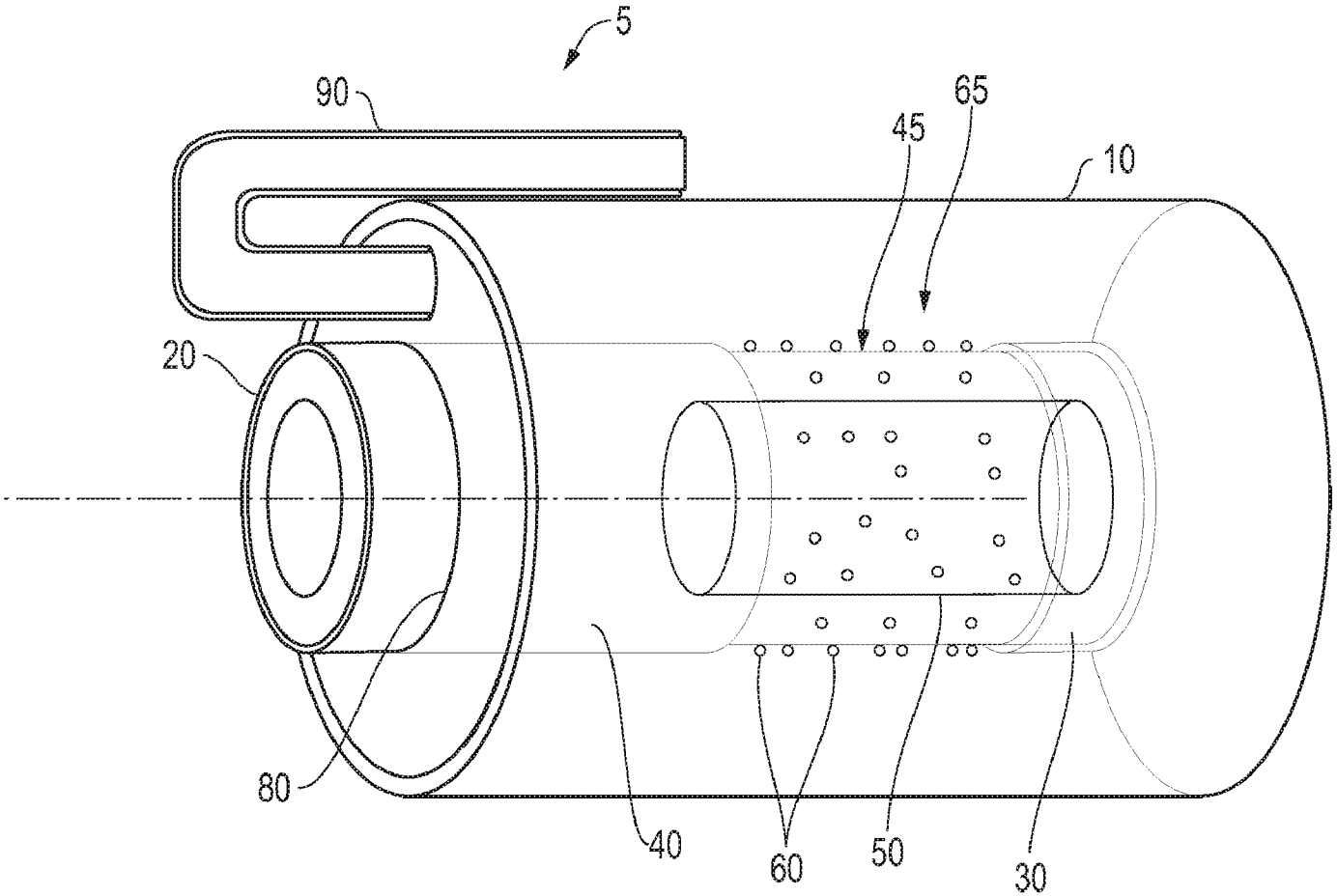
FIG. 3 illustrates another exemplary embodiment of a system including a magnetic electrode in the ON state.

In FIG. 3, in contrast, the magnetic element 50 is moved all the way into conductor 20 (i.e. inside conductive portion 45) to the proximity of the zinc electrode 30. The nano-metal particles are pulled onto the surface of conductive portion 45 which is in close proximity of the zinc electrode 30, thereby allowing electrolysis to commence by making an electrical connection. As a result, electrolytic hydrogen production begins. The hydrogen is produced from the nano-metal electrode formed on the conductive portion 45 of hollow conductor 20. The production of hydrogen can be reduced or terminated by moving the magnetic element 50 toward the "off" position until it is within the insulated portion 40, as in FIG. 2.

In an exemplary embodiment, the extent of insertion of the magnetic element 50 within the conductor 20, in other words, its location relative to the "on" and "off" positions described above, may be used to control the rate of hydrogen gas production from the hydrogen generator cell 5. Alternatively, the second electrode (which is formed by magnetically attracted nano-metal particles on conductive portion 45) may be sized for a particular hydrogen output by a predetermined sizing of the area of conductive portion 45, or through application to the conductive portion 45 of a variable magnet permeable coating which will change the strength of the magnetic field. The production rate of hydrogen may also be controlled by temperature: increasing electrolyte temperature increases the rate of hydrogen generation.

Figure 4:
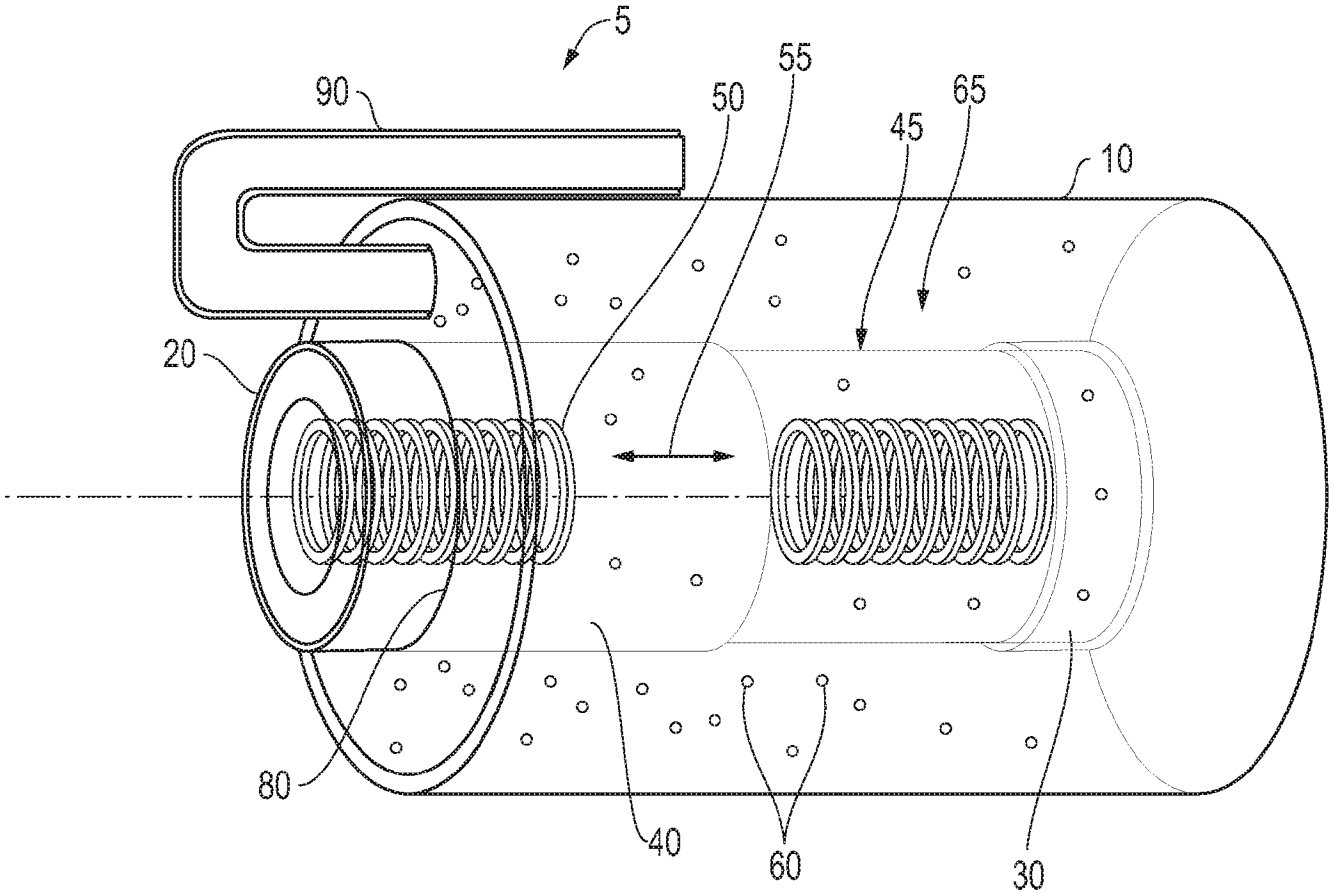
FIG. 4 illustrates another exemplary embodiment of a system including an electro-magnetic electrode.

FIG. 4 illustrates an alternative exemplary embodiment wherein the magnetic element 50 is an electro-magnet movable laterally as shown by arrow 55. When power is supplied to the windings of the electro-magnet 50, it becomes magnetic. Thus, when fully inserted into the hollow conductor 20, the electro-magnetic element 50 pulls nano-particles onto the outer surface of conductive portion 45 of conductor 20 to form a second electrode.

The electro-magnetic material of the electro-magnet(s) may be selected from any suitable material, such as electro-magnetic alloys of iron or steel. Operation of the hydrogen generation cell 5 is similar to the above description using permanent magnets, but electro-magnets provide some additional flexibility and ease of control. For example, an electro-magnet readily permits control of hydrogen production by controlling magnetic field strength. Magnetic field strength may be controlled to some extent by controlling electrical current supplied to the electro-magnet.

An electrode for electrolysis of water using an electrical current may be constructed by forming a coating of nano-material around a conductive magnet, thereby producing a cathode of one nano-material and an anode of a second nano-material.

While at least one exemplary embodiment has been presented in the foregoing detailed description of the invention, it should be appreciated that a wide range of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A controlled electrolysis system for generating hydrogen gas by creating a second electrode with a magnetic field and controlling a magnetic field strength to control a rate of hydrogen production, the system comprising:

a first electrode;

an electrolyte comprising colloidal silver, colloidal magnesium, and nano-metal particles, the electrolyte in contact with the first electrode;

a conductive body portion in contact with the electrolyte;

a magnetic element having the magnetic field at least partially encompassing the conductive body portion, the magnetic field pulling the nano-metal particles from the electrolyte to at least partially coat a surface of the conductive body portion to form the second electrode, the strength of the magnetic field controllable to either increase or decrease the rate of hydrogen production by controlling an extent of the surface of the conductive body portion coated with the nano-metal particles;

wherein the magnetic element comprises a cylindrical body; and wherein the system further comprises a sleeve with an annulus sized to receive the cylindrical body comprising the conductive body portion and an insulated portion.

2. The electrolysis system of claim 1, wherein the nano-metal particles comprise at least one of nano-nickel, nano-iron, or nano-nickel-iron alloy particles.

3. The electrolysis system of claim 1, wherein the magnetic element is movable within the insulated body portion of the sleeve to control the strength of the magnetic field at the conductive body portion.

4. The electrolysis system of claim 1, further comprising a gas seal surrounding the sleeve, the first electrode and electrolyte, and a gas outlet extending through the seal.

5. The electrolysis system of claim 1, wherein the magnetic element is an electro-magnet and the strength of the magnetic field at least partially encompassing the conductive portion is controlled by control of electrical power to the electro-magnet.

6. The electrolysis system of claim 1, wherein the first electrode comprises zinc or a zinc coated metal.

7. The electrolysis system of claim 6, wherein the nano-metal particles comprise at least one of nano-nickel, nano-iron, or nano-nickel-iron alloy particles.

8. A system for controlled generation of hydrogen gas by creating a second electrode with a magnetic field and controlling a magnetic field strength to control a rate of hydrogen production, the system comprising:

a first non-magnetic electrode;

an electrolyte comprising colloidal silver, colloidal magnesium, and nano-metal particles;

a hollow body having a conductive portion and an insulated portion, the hollow body located in contact with the electrolyte; and a magnetic element having the magnetic field, the magnetic field at least partially encompassing the hollow body, the magnetic field pulling the nano-metal particles from the electrolyte to at least partially coat an outer surface of the conductive portion to form the second electrolyte and produce hydrogen, an extent of influence of the magnetic field on the conductive portion controlledly variable to control the rate of hydrogen production.

9. The electrolysis system of claim 8, wherein the nano-metal particles comprise at least one of nano-nickel, nano-iron, or nano-nickel-iron alloy.

10. The electrolysis system of claim 9, wherein the first electrode comprises zinc or a zinc coated metal.

11. The electrolysis system of claim 8, wherein the magnetic element comprises a cylindrical body and the hollow body comprises a sleeve with an annulus sized to receive the cylindrical body.

12. The electrolysis system of claim 8, wherein the magnetic element is movable within the insulated portion of the hollow body to control the influence of the magnetic field on the conductive portion.

13. The electrolysis system of claim 8, further comprising a cell containing the first electrode and the electrolyte, the cell gas-sealed and having an outlet port for removal of produced hydrogen gas.

14. The electrolysis system of claim 8, wherein the first electrode comprises zinc or a zinc coated metal.

15. The electrolysis system of claim 8, wherein the magnetic element is at least one electro-magnet.

16. A system for controlled generation of hydrogen gas by creating a second electrode with a magnetic field and controlling a magnetic field strength to control a rate of hydrogen production, the system comprising:

a cell comprising:

a first non-magnetic electrode;

an electrolyte comprising colloidal silver, colloidal magnesium, and nano-metal particles, the nano-metal particles comprising at least one of nano-nickel, nano-iron or a nano-nickel-iron alloy, the electrolyte in contact with the first non-magnetic electrode;

a hollow body having a conductive portion and an insulated portion, the hollow body in contact with the electrolyte; and at least one controlled magnetic element located within the hollow body and pulling the nano-metal particles from the electrolyte to at least partially coat an outer surface of the hollow body to form the second electrode to produce hydrogen by electrolysis, the magnetic element controlling the rate of hydrogen production by controlling the strength of the magnetic field at the conductive portion of the hollow body; and a gas-tight end cover enclosing contents of the cell, the end cover having an outlet therein for removal of produced hydrogen.

17. The electrolysis system of claim 16, wherein the magnetic element is movable within the hollow body to control the strength of the magnetic field to control the rate of hydrogen production.

18. The electrolysis system of claim 16, wherein the magnetic element is an electro-magnet and the magnetic field strength is varied to control the rate of hydrogen production.

19. The electrolysis system of claim 16, wherein the first electrode comprises zinc or a zinc coated metal.

* * * * *